US011538430B2

(12) United States Patent
Cao

(10) Patent No.: US 11,538,430 B2
(45) Date of Patent: Dec. 27, 2022

(54) DISPLAY DEVICE AND INSPECTION METHOD THEREFOR

(71) Applicant: HKC CORPORATION LIMITED, Shenzhen (CN)

(72) Inventor: Junhong Cao, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 682 days.

(21) Appl. No.: 16/319,492

(22) PCT Filed: Nov. 9, 2018

(86) PCT No.: PCT/CN2018/114687
§ 371 (c)(1),
(2) Date: Jan. 22, 2019

(87) PCT Pub. No.: WO2020/082433
PCT Pub. Date: Apr. 30, 2020

(65) Prior Publication Data

US 2021/0335304 A1 Oct. 28, 2021

(30) Foreign Application Priority Data

Oct. 22, 2018 (CN) ..... 201811230464.6

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 2310/08* (2013.01)

(58) Field of Classification Search
CPC .. G09G 3/3677; G09G 3/006; G09G 2310/08; G09G 3/3651; G09G 3/36; G09G 3/30; G09G 3/18
See application file for complete search history.

(56) References Cited

U.S. PATENT DOCUMENTS

2002/0075248 A1* 6/2002 Morita ..... G09G 3/3677 345/204
2005/0093772 A1* 5/2005 Kim ..... G09G 3/296 345/30
2005/0285830 A1* 12/2005 Iwabuchi ..... G09G 3/20 345/77
2009/0231261 A1 9/2009 Matsumoto et al.
(Continued)

FOREIGN PATENT DOCUMENTS

CN 101017640 A 8/2007
CN 103295643 A 9/2013
(Continued)

OTHER PUBLICATIONS

Xin Wang, the ISA written comments, Jun. 2019, CN.

*Primary Examiner* — Michael A Faragalla
*Assistant Examiner* — Sujit Shah

(57) ABSTRACT

This application discloses a display device and an inspection method. The display device includes a display panel and a control circuit board, the display panel includes a display region and switching devices, the switching devices are arranged between the display region and the control circuit board and the control circuit board is configured to drive the display panel.

11 Claims, 5 Drawing Sheets

(56) References Cited

U.S. PATENT DOCUMENTS

| | | | | |
|---|---|---|---|---|
| 2010/0302215 | A1* | 12/2010 | Tsai | G09G 3/3648 345/204 |
| 2010/0309236 | A1* | 12/2010 | Min | G09G 3/3648 345/691 |
| 2011/0148825 | A1* | 6/2011 | Ueno | G09G 3/006 345/204 |
| 2015/0109018 | A1* | 4/2015 | Ma | G09G 3/006 324/760.02 |
| 2016/0148588 | A1* | 5/2016 | Huang | G09G 3/3648 345/100 |
| 2018/0343750 | A1* | 11/2018 | Chen | H05K 3/027 |

FOREIGN PATENT DOCUMENTS

| | | | |
|---|---|---|---|
| CN | 204406007 | U | 6/2015 |
| CN | 106157858 | A | 11/2016 |
| CN | 107015408 | A | 8/2017 |
| CN | 107300794 | A | 10/2017 |

* cited by examiner

DISPLAY DEVICE AND INSPECTION METHOD THEREFOR

This application claims priority to Chinese Patent Application No. CN201811230464.6, filed with the Chinese Patent Office on Oct. 22, 2018 and entitled "DISPLAY DEVICE AND INSPECTION METHOD THEREFOR", which is incorporated herein by reference in its entirety.

TECHNICAL FIELD

This application relates to the field of display technologies, and more specifically, to a display device and an inspection method therefor.

BACKGROUND

The description herein provides only background information related to this application, but does not necessarily constitutes the prior art.

Along with the development and progress of sciences and technologies, the flat-panel display has become a mainstream display product and been extensively applied due to advantages of thin body, power saving, low radiation and the like. Flat-panel displays include thin film transistor-liquid crystal displays (TFT-LCDs), organic light-emitting diode (OLED) displays and the like. Herein, a TFT-LCD controls rotation directions of liquid crystal molecules to refract light of a backlight module to generate a picture and has many advantages such as thin body, power saving and no radiation. An OLED display is manufactured by using OLEDs and has many advantages such as autoluminescence, quick response, high definition and contrast and capabilities of implementing flexible display and large-area full-color display.

A gate driver on array (GOA) technology may be applied to a liquid crystal display panel array manufacturing process. A drive circuit for horizontal scanning lines is manufactured on a substrate around a display region to complete driving the horizontal scanning lines instead of an external chip. A double-sided simultaneous driving design is usually adopted for GOA circuits. However, such a design may only inspect defects of the GOA circuits on both sides and may not inspect the defects of the GOA circuits on a single side, which may bring the problem of missing inspection of the defects of the GOA circuits on the single side in an array test.

SUMMARY

An objective of this application is to provide a display device and an inspection method therefor, to prevent missing inspection of a gate drive circuit on a single side.

To achieve the objective, this application provides a display device, comprising a display panel and a control circuit board configured to drive the display panel, wherein the display panel comprises:

a first gate drive circuit and a second gate drive circuit, positioned on two sides of a display region of the display panel respectively, the first gate drive circuit and the second gate drive circuit being coupled to the control circuit board and configured to provide a row drive signal for the display region; and switching devices, arranged between the display region and the control circuit board, wherein the switching devices comprise a first switching device and a second switching device, the first switching device controls the first gate drive circuit whether to output the row drive signal or not, and the second switching device controls the second gate drive circuit whether to output the row drive signal or not.

Optionally, the switching devices are positioned between the gate drive circuits and the control circuit board.

Optionally, the switching devices comprise TFTs, gates of the TFTs are connected to an enable signal, and the TFTs are controlled through the enable signal to be turned off and turned on.

Optionally, the display panel comprises first signal lines, and the enable signal is connected to the gates of all the TFTs in the same switching devices through the first signal lines.

Optionally, the control circuit board comprises a timing controller and a drive circuit board, the timing controller is connected to the drive circuit board, and the drive circuit board is connected to the gate drive circuits.

Optionally, the switching devices are positioned between the gate drive circuits and the display region.

Optionally, the switching devices are integrated in the gate drive circuits.

This application further discloses a display device, comprising:

a control circuit board configured to drive a display panel and the display panel, wherein the display panel comprises:

a first gate drive circuit and a second gate drive circuit, positioned on two sides of a display region of the display panel respectively, coupled to the control circuit board and configured to provide a row drive signal for the display region; and switching devices, arranged between the display region and the control circuit board, wherein the switching devices comprise a first switching device and a second switching device, the first switching device controls the first gate drive circuit whether to output the row drive signal or not, and the second switching device controls the second gate drive circuit whether to output the row drive signal or not; and the display panel comprises first signal lines, and an enable signal is connected to gates of all TFTs in the same switching devices through the first signal lines.

This application further discloses an inspection method for a display device, and the display device comprises:

a display panel and a control circuit board configured to drive the display panel, wherein the display panel comprises: a first gate drive circuit and a second gate drive circuit, positioned on two sides of a display region of the display panel respectively, the first gate drive circuit and the second gate drive circuit being coupled to the control circuit board and configured to provide a row drive signal for the display region; and switching devices, arranged between the display region and the control circuit board, wherein the switching devices comprise a first switching device and a second switching device, the first switching device controls the first gate drive circuit whether to output the row drive signal or not, and the second switching device controls the second gate drive circuit whether to output the row drive signal or not, wherein the inspection method comprises:

controlling the first switching device to be turned on and controlling the second switching device to be turned off;

detecting an output signal of the first gate drive circuit;

controlling the first switching device to be turned off and controlling the second switching device to be turned on:

detecting an output signal of the second gate drive circuit; and outputting an inspection result.

Optionally, the first switching device and the second switching device are controlled through an enable signal to be turned off and turned on.

Optionally, the switching devices are positioned between the gate drive circuits and the control circuit board.

Optionally, the switching devices comprise TFTs and gates of the TFTs are connected to the enable signal.

Optionally, the TFTs are controlled through the enable signal to be turned off and turned on.

Optionally, the display panel comprises first signal lines, and the enable signal is connected to the gates of all the TFTs in the same switching devices through the first signal lines.

Optionally, the control circuit board comprises a timing controller and a drive circuit board, the timing controller is connected to the drive circuit board, and the drive circuit board is connected to the gate drive circuits.

Optionally, the switching devices are positioned between the gate drive circuits and the display region.

Optionally, the switching devices are integrated in the gate drive circuits.

Compared with a solution capable of inspecting only gate drive circuits on both sides, in this application, two groups of switching devices are additionally arranged for additional defect inspection of the gate drive circuits on a single side, so that defect inspection of the gate drive circuits on the single side or both sides may be implemented, the problem of missing inspection in an array test is prevented and the yield is improved.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Apparently, the accompanying drawings in the following description merely show some embodiments of this application, and persons of ordinary skill in the art may still derive other drawings from these accompanying drawings without creative effort. In the accompanying drawings.

DETAILED DESCRIPTION

Figure 1:
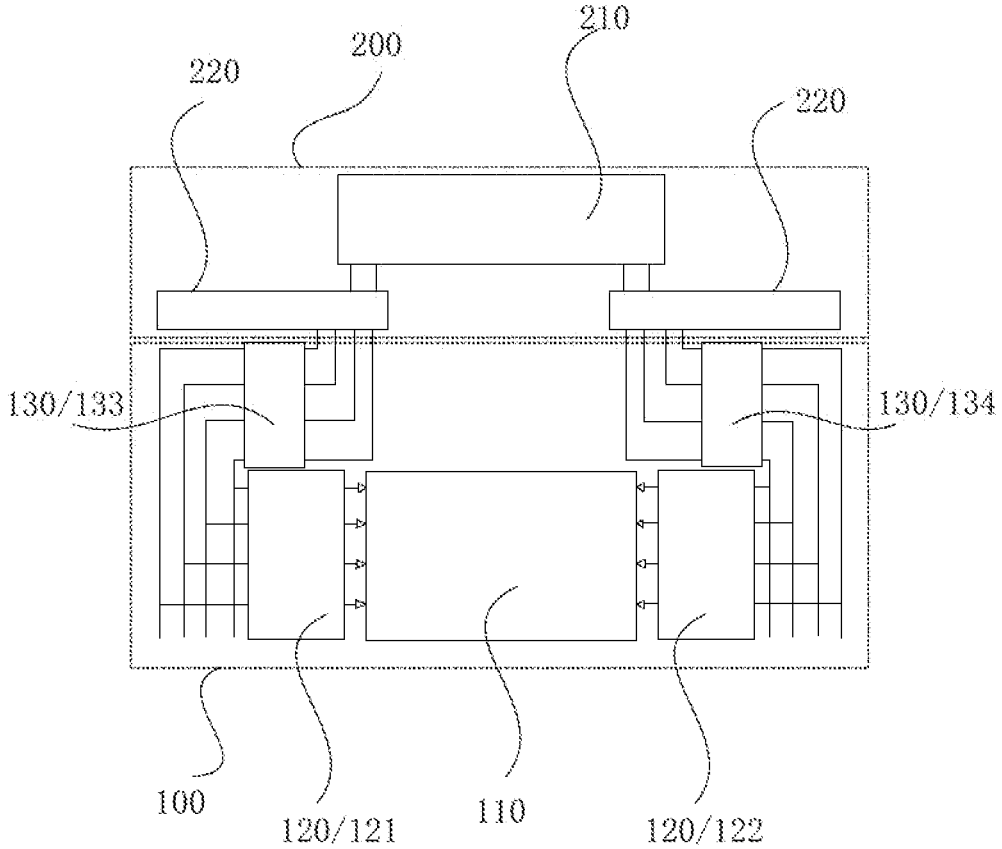
FIG. 1 is a schematic diagram of a display device according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of" means two or more than two. In addition, the terms "include", "include" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary; or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "include" when used in this specification, specify the presence of stated features, integers, steps, operations, elements, and/or components, but do not preclude the presence or addition of one or more other features, integers, steps, operations, elements, components, and/or combinations thereof.

This application is described below with reference to the accompanying drawings and optional embodiments.

Figure 2:
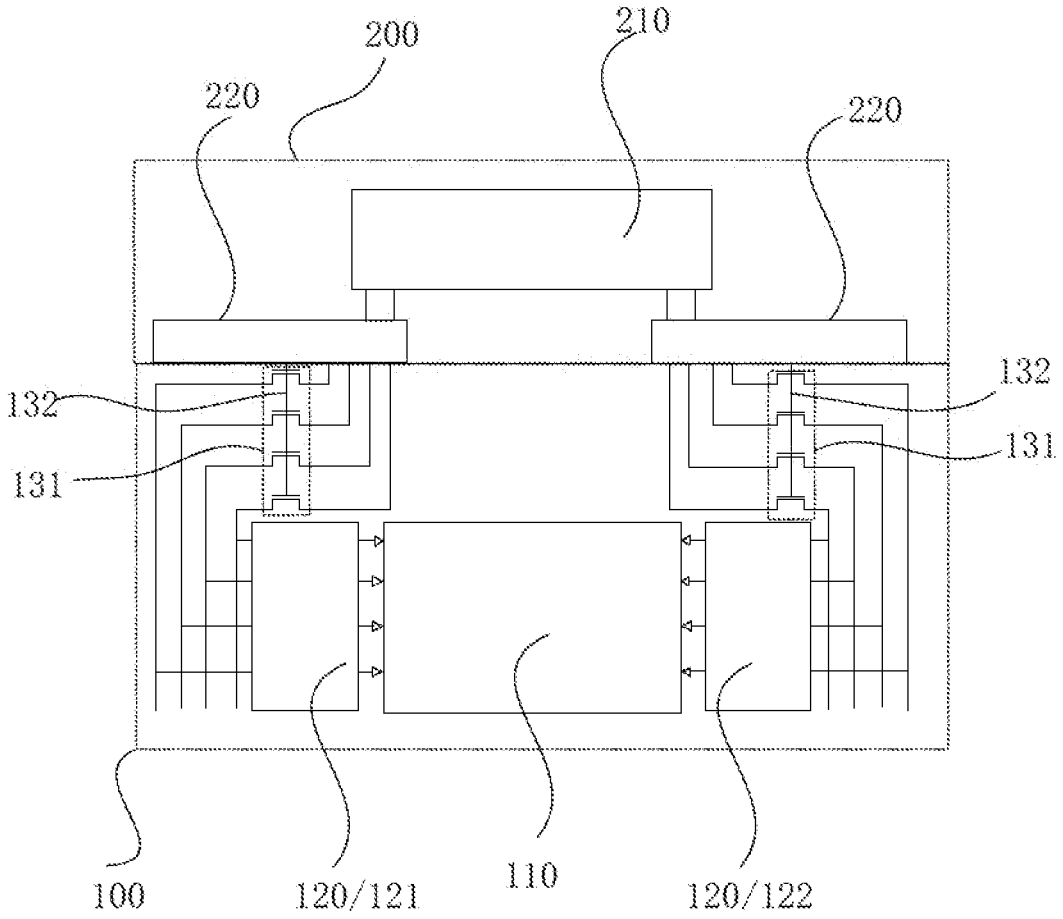
FIG. 2 is a schematic diagram of a switching device of a display device according to an embodiment of this application.

Referring to FIG. 1 and FIG. 2, an embodiment of this application provides a display device, including a display panel 100 and a control circuit board 200 configured to drive the display panel. The display panel 100 includes:

a first gate drive circuit 121 and a second gate drive circuit 122, positioned on two sides of a display region 110 of the display panel 100 respectively, coupled to the control circuit board 200 and configured to provide a row drive signal for the display region 110; and switching devices 130, arranged between the display region 110 and the control circuit board 200. The switching devices 130 include a first switching device 133 and a second switching device 134, the first switching device 133 controls the first gate drive circuit 121 whether to output the row drive signal or not, and the second switching device 134 controls the second gate drive circuit 122 whether to output the row drive signal or not.

In the solution, a GOA technology has been extensively applied to the liquid crystal display panel industry. A double-sided simultaneous driving design is usually adopted for gate drive circuits and two groups of gate drive circuits 120 are positioned on the two sides of the display region 110 respectively and provide the drive signal. The two groups of switching devices 130 are additionally arranged between the display region 110 and the control circuit board 200, which may not only implement defect inspection of the gate drive circuits 120 on both sides but also implement defect inspection of the gate drive circuits 120 on a single side and prevent the condition of missing inspection of the gate drive circuits 120 on the single side in an array test, thereby improving the yield. This application is particularly suitable for a display device of a gate on array (GOA) architecture.

In an embodiment, the switching devices 130 are positioned between the gate drive circuits 120 and the control circuit board 200.

In the solution, for a GOA circuit product, there are only wires on array (WOAs) between the gate drive circuits 120 and the control circuit board 200, widths of the WOAs may be regulated and the switching devices 130 may be arranged herein with little impact on the circuit board on the side.

In an embodiment, the switching devices 130 include TFTs 131, gates of the TFTs 131 are connected to an enable signal, and the TFTs 131 are controlled through the enable signal to be turned off and turned on.

In the solution, each group of switching device 130 includes a group of TFTs 131. The gates of the TFTs 131 are connected to the enable signal. The enable signal may be controlled to control the TFTs 131. That is, the switching devices 130 are controlled through the enable signal to be turned off and turned on. The switching devices 130 may be turned off and turned on to implement defect inspection of the gate drive circuit 120 on the single side.

In an embodiment, the display panel 100 includes first signal lines 132, and the enable signal is connected to the gates of all the TFTs 131 in the same switching devices through the first signal lines 132.

In the solution, the first signal lines 132 are connected to the gates of all the TFTs 131 in the same switching devices. All the gates in the same switching devices are connected in series through the first signal lines 132, then the TFTs 131 of the same groups may be simultaneously controlled and ail the TFTs 131 in the same switching devices may be simultaneously turned off and simultaneously turned on. The operation procedure is simplified and convenience for operation is brought to an operator.

In an embodiment, the control circuit board 200 includes a timing controller 210 and a drive circuit board 220, the timing controller 210 is connected to the drive circuit board 220 and the drive circuit board 220 is connected to the gate drive circuits 120.

In the solution, the control circuit board 200 includes the timing controller 210 and the drive circuit board 220, the timing controller 210 is arranged to be a timing control circuit of the display device and the drive circuit board 220 is configured to carry the drive circuit and be connected to the timing controller 210. The drive circuit board 220 is connected to the gate drive circuits 120 and connections therebetween are implemented through wires.

Figure 3:
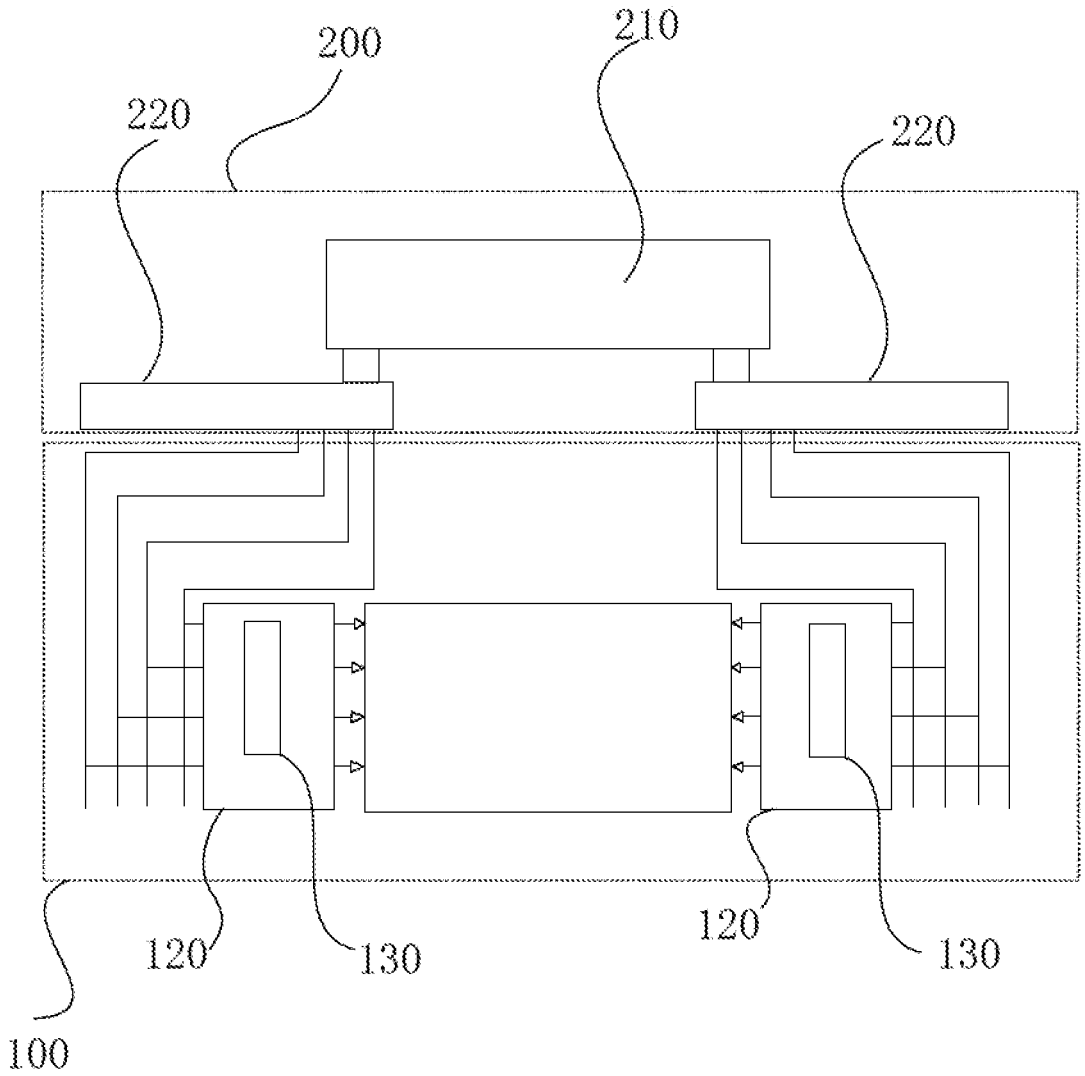
FIG. 3 is a schematic diagram of a display device according to an embodiment of this application.

Referring to FIG. 3, the embodiment provides an alternative positioning manner for the switching devices. The switching devices 130 are positioned between the gate drive circuits 120 and the display region 110.

In the solution, mounting positions of the switching devices 130 are provided. The switching devices 130 may be positioned between the gate drive circuits 120 and the display region 110 to implement defect inspection of the gate drive circuit 120 on the single side.

Figure 4:
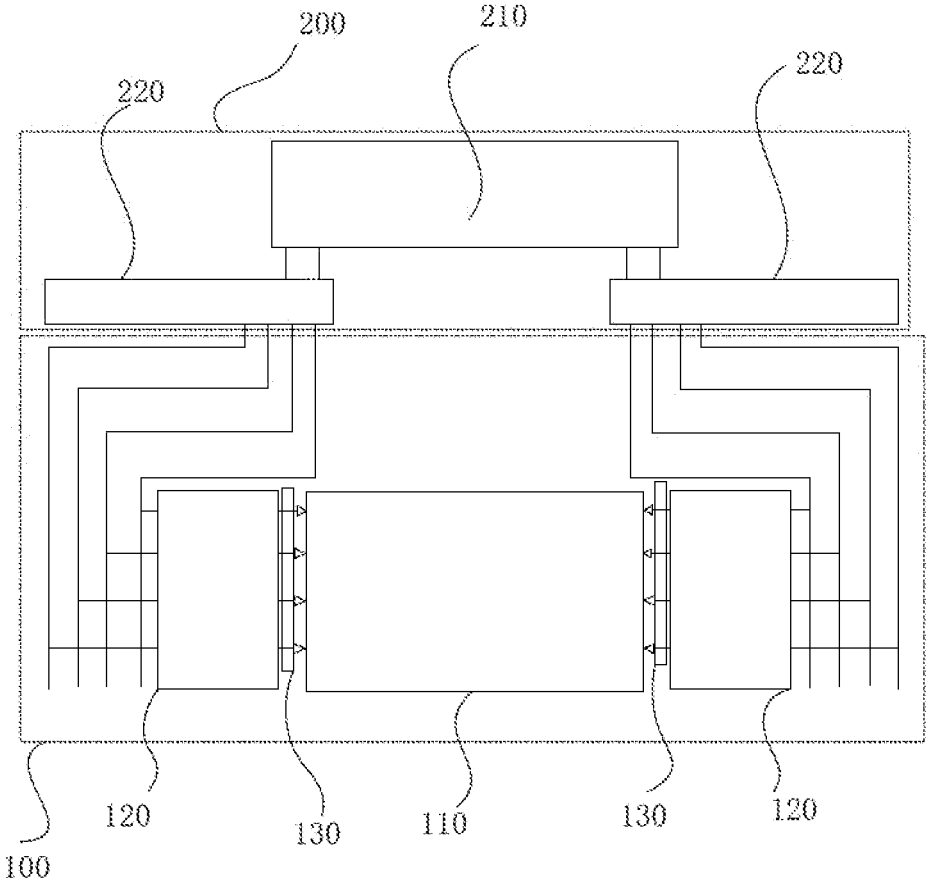
FIG. 4 is a schematic diagram of a display device according to an embodiment of this application.
Figure 5:
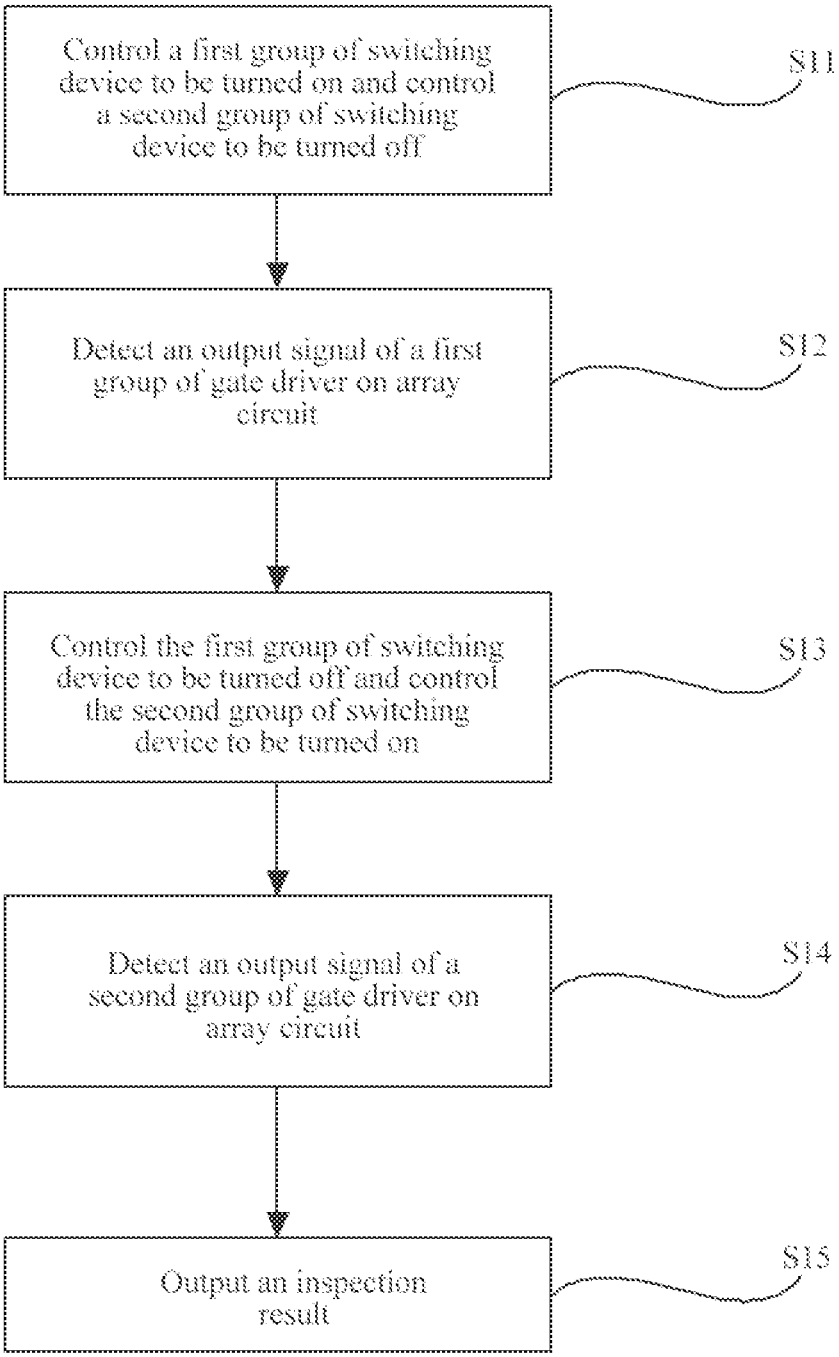
FIG. 5 is a schematic flowchart of an inspection method for a display device according to another embodiment of this application.

Referring to FIG. 4, the embodiment provides an alternative positioning manner for the switching devices. The switching devices 130 are integrated in the gate drive circuits 120.

In the solution, the switching devices 130 may be integrated in the gate drive circuits 120 to implement defect inspection of the gate drive circuit on the single side. In this case, the switching devices 130 are positioned in the gate drive circuits 120, so that space can be saved and a space utilization rate can be increased.

In another embodiment of this application, referring to FIG. 1 and FIG. 2, a display device is disclosed. The display device includes a display panel 100 and a control circuit board 200 configured to drive the display panel. The display panel 100 includes:

a first gate drive circuit 121 and a second, gate drive circuit 122, positioned on two sides of a display region 110 of the display panel 100 respectively, coupled to the control circuit board 200 and configured to provide a row drive signal for the display region 110; and switching devices 130, arranged between the display region 110 and the control circuit board 200. The switching devices 130 include a first switching device 133 and a second switching device 134, the first switching device 133 controls the first gate drive circuit 121 whether to output the row drive signal or not, and the second switching device 134 controls the second gate drive circuit 122 whether to output the row drive signal or not. The display panel 100 includes first signal lines 132, and the enable signal is connected to gates of all TFTs 131 in the same switching devices through the first signal lines 132.

The GOA technology has been extensively applied to the liquid crystal display panel industry. A double-sided simultaneous driving design is usually adopted for gate drive circuits and two groups of gate drive circuits 120 are positioned on the two sides of the display region 110 respectively and provide the drive signal. The two groups of switching devices 130 are additionally arranged between the display region 110 and the control circuit board 200, which may not only implement defect inspection of the gate drive circuits 120 on both sides but also implement defect inspection of the gate drive circuit 120 on single side and prevent the condition of missing inspection of the gate drive circuit on the single side in an array test, thereby improving the yield. For a GOA circuit product, there are only WOAs between the gate drive circuits 120 and the control circuit board 200, widths of the WOAs may be regulated and the switching devices 130 may be arranged herein with little impact on the circuit board on the side. Each group of switching device 130 includes a group of TFTs 131. The gates of the TFTs 131 are connected to the enable signal. The enable signal may be controlled to control the TFTs 131. That is, the switching devices 130 are controlled through the enable signal to be turned off and turned on. The switching devices 130 may be turned off and turned on to implement defect inspection of the gate drive circuit 120 on the single side. The first signal lines 132 are connected to the gates of all the TFTs 131 in the same switching devices. All the gates in the same switching devices are connected in series through the first signal lines 132, then the TFTs 131 of the same groups may be simultaneously controlled and all the TFTs 131 in the same switching devices may be simultaneously turned off and simultaneously turned on. The operation flow is simplified and convenience for operation is brought to an operator. The control circuit board 200 includes a timing controller 210 and a drive circuit board 220, the timing controller 210 is arranged to be a timing control circuit of the display device and the drive circuit board 220 is configured to carry the drive circuit and be connected to the timing controller 210. The drive circuit board 220 is connected to the gate drive circuits 120 and connections therebetween are implemented through wires.

In another embodiment of this application, referring to FIG. 1 to FIG. 5, an inspection method for a display device is disclosed. The display device includes a display panel 100 and a control circuit board 200 configured to drive the display panel. The display panel 100 includes:

a first gate drive circuit 121 and a second gate drive circuit 122, positioned on two sides of a display region 110 of the display panel 100 respectively, coupled to the control circuit board 200 and configured to provide a row drive signal for the display region 110; and switching devices 130, arranged between the display region 110 and the control circuit board 200. The switching devices 130 include a first switching device 133 and a second switching device 134, the first switching device 133 controls the first gate drive circuit 121 whether to output the row drive signal or not, and the second switching device 134 controls the second gate drive circuit 122 whether to output the row drive signal or not.

The inspection method includes the following steps.

S11: Control the first switching device to be turned on and control the second switching device to be turned off.

S12: Detect an output signal of the first gate drive circuit.

S13: Control the first switching, device to be turned off and control the second switching device to be turned on.

S14: Detect an output signal of the second gate drive circuit.

S15: Output an inspection result.

In the solution, the first switching device is controlled to be turned on and the second switching device is controlled to be turned off. In this case, the first gate drive circuit is in an ON state and the second gate drive circuit is in an OFF state. Meanwhile, the output signal of the first gate drive circuit is detected. Then, the first switching device is turned off and the second switching device is turned on. In this case, the first gate drive circuit is in the OFF state and the second gate drive circuit is in the ON state. Meanwhile, the output signal of the first gate drive circuit is detected and a judgment is made according to two detection results.

In an embodiment, the first switching device and the second switching device are controlled through an enable signal to be turned off and turned on.

In the solution, when the enable signal is connected, the first switching device is in the ON state and, in this case, the first gate drive circuit is switched on; and when the enable signal is disconnected, the first switching device is in the OFF state and, in this case, the first gate drive circuit is switched off.

In an embodiment, the switching devices 130 are alternatively positioned between the gate drive circuits 120 and the control circuit board 200.

In the solution, for a GOA circuit product, there are only WOAs between the gate drive circuits 120 and the control circuit board 200, widths of the WOAs may be regulated and the switching devices 130 may be arranged herein with little impact on the circuit board on the side.

In an embodiment, the switching devices 130 include TFTs 131 and gates of the TFTs 131 are connected to the enable signal.

In the solution, each group of switching device 130 includes a group of TFTs 131. The gates of the TFTs 131 are connected to the enable signal. The enable signal may be controlled to control the TFTs 131. That is, the switching devices 130 are controlled through the enable signal to be turned off and turned on. The switching devices 130 may be turned off and turned on to implement defect inspection of the gate drive circuit 120 on the single side.

In an embodiment, the TFTs 131 are controlled through the enable signal to be turned off and turned on.

In the solution, the TFTs 131 are controlled through the enable signal to be turned off and turned on and the switching devices 130 are further controlled to be turned off and turned on.

In an embodiment, the display panel 100 includes first signal lines 132, and the enable signal is connected to the gates of all the TFTs 131 in the same switching devices through the first signal lines 132.

In the solution, the first signal lines 132 are connected to the gates of all the TFTs 131 in the same switching devices. All the gates in the same switching devices are connected in series through the first signal lines 132, then the TFTs 131 of the same groups may be simultaneously controlled and all the TFTs 131 in the same switching devices may be simultaneously turned off and simultaneously turned on. The operation flow is simplified and convenience for operation is brought to an operator.

Tri an embodiment, the control circuit board 200 includes a timing controller 210 and a drive circuit board 220, the timing controller 210 is connected to the drive circuit board 220 and the drive circuit board 220 is connected to the gate drive circuits 120.

In the solution, the control circuit board 200 includes the timing controller 210 and the drive circuit board 220, the timing controller 210 is arranged to be a timing control circuit of the display device and the drive circuit board 220 is configured to carry the drive circuit and connected to the timing controller 210. The drive circuit board 220 is connected to the gate drive circuits 120 and connections therebetween are implemented through wires.

Referring to FIG. 4, the embodiment provides an alternative positioning manner for the switching devices. The switching devices 130 are integrated in the gate drive circuits 120.

In the solution, the switching devices 130 may be integrated in the gate drive circuits 120 to implement defect inspection of the gate drive circuit on the single side. In this case, the switching devices 130 are positioned in the gate drive circuits 120, so that space can be saved and a space utilization rate can be increased.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

The display panel of this application may be a twisted nematic (TN) panel, an in-plane switching (IPS) panel, or a multi-domain vertical alignment (VA) panel, and may certainly be any other suitable type of panel.

The foregoing content is merely detailed descriptions of this application made with reference to specific optional implementations, and should not be considered limiting of specific implementations of this application. Persons of ordinary skill in the art can further make simple deductions or replacements without departing from the concept of this application, and such deductions or replacements should all be considered as falling within the protection scope of this application.

What is claimed:

1. A display device, comprising:

a display panel; and a control circuit board, configured to drive the display panel, wherein the display panel comprises:

a first gate drive circuit and a second gate drive circuit, positioned on two sides of a display region of the display panel respectively, the first gate drive circuit and the second gate drive circuit being coupled to the control circuit board and configured to provide a row drive signal for the display region; and switching devices, arranged between the display region and the control circuit board, wherein the switching devices comprise a first switching device and a second switching device, the first switching device controls the first gate drive circuit whether to output the row drive signal or not to inspect whether there is a defect with the first gate drive circuit, and the second switching device controls the second gate drive circuit whether to output the row drive signal or not to inspect whether there is a defect with the second gate drive circuit;

wherein the switching devices are positioned between the first and second gate drive circuits and the control circuit board; wherein the first switching device is arranged between the first gate drive circuit and the control circuit board, and the second switching device is arranged between the second gate drive circuit and the control circuit board;

wherein the first switching device is electrically connected between the control circuit board and the first gate drive circuit, and the second switching device is electrically connected between the control circuit board and the second gate drive circuit;

wherein each of the first switching device and the second switching device comprises a plurality of thin film transistors, wherein each of the plurality of thin film transistors of the first switching device comprises a gate electrode connected to an enable signal output from a first pin of the control circuit board, a source electrode connected to a second pin of the control circuit board, and a drain electrode connected to a corresponding pin of the first gate drive circuit; wherein each of the plurality of thin film transistors of the second switching device comprises a gate electrode connected to an enable signal output from a third pin of the control circuit board, a source electrode connected to a fourth pin of the control circuit board, and a drain electrode connected to a corresponding pin of the second gate drive circuit.

2. The display device according to claim 1, wherein the thin film transistors (TFTs) of each of the first switching device and the second switching device are controlled through the respective enable signal to be turned off and turned on.

3. The display device according to claim 2, wherein the display panel comprises first signal lines, and the respective enable signal is connected to the gates of all the TFTs in each of the first switching device and the second switching device through the respective first signal line.

4. The display device according to claim 1, wherein the control circuit board comprises a timing controller and a drive circuit board, the timing controller is connected to the drive circuit board, and the drive circuit board is connected to the gate drive circuits.

5. The display device according to claim 1, wherein the display device is of a gate on array (GOA) architecture, and there are only wires on array (WOAs) between the gate drive circuits and the control circuit board, and widths of the WOAs are adjusted to accommodate the switching devices arranged between the gate drive circuits and the control circuit board.

6. An inspection method for a display device, the display device comprising:

a display panel; and a control circuit board, configured to drive the display panel, wherein the display panel comprises:

a first gate drive circuit and a second gate drive circuit, positioned on two sides of a display region of the display panel respectively, the first gate drive circuit and the second gate drive circuit being coupled to the control circuit board and configured to provide a row drive signal for the display region; and switching devices, arranged between the display region and the control circuit board, wherein the switching devices comprise a first switching device and a second switching device, the first switching device controls the first gate drive circuit whether to output the row drive signal or not to inspect whether there is a defect with the first gate drive circuit, and the second switching device controls the second gate drive circuit whether to output the row drive signal or not to inspect whether there is a defect with the second gate drive circuit, wherein the switching devices are positioned between the first and second gate drive circuits and the control circuit board, wherein the first switching device is arranged between the first gate drive circuit and the control circuit board, and the second switching device is arranged between the second gate drive circuit and the control circuit board; wherein the first switching device is electrically connected between the control circuit board and the first gate drive circuit, and the second switching device is electrically connected between the control circuit board and the second gate drive circuit; wherein each of the first switching device and the second switching device comprises a plurality of thin film transistors, wherein each of the plurality of thin film transistors of the first switching device comprises a gate electrode connected to an enable signal output from a first pin of the control circuit board, a source electrode connected to a second pin of the control circuit board, and a drain electrode connected to a corresponding pin of the first gate drive circuit; wherein each of the plurality of thin film transistors of the second switching device comprises a gate electrode connected to an enable signal output from a third pin of the control circuit board, a source electrode connected to a fourth pin of the control circuit board, and a drain electrode connected to a corresponding pin of the second gate drive circuit; wherein the inspection method comprises:

controlling the first switching device to be turned on and controlling the second switching device to be turned off;

detecting an output signal of the first gate drive circuit;

controlling the first switching device to be turned off and controlling the second switching device to be turned on;

detecting an output signal of the second gate drive circuit; and outputting an inspection result.

7. The inspection method for a display device according to claim 6, wherein the first switching device and the second switching device are each controlled through the respective enable signal to be turned off and turned on.

8. The inspection method for a display device according to claim 6, wherein the switching devices comprise thin film transistors (TFTs) and gates of the TFTs of each of the first switching device and the second switching device are connected to the respective enable signal.

9. The inspection method for a display device according to claim 8, wherein the TFTs of each of the first switching device and the second switching device are controlled through the respective enable signal to be turned off and turned on.

10. The inspection method for a display device according to claim 8, wherein the display panel comprises first signal lines, and the respective enable signal is connected to the gates of all the TFTs in each of the first switching device and the second switching device through the respective first signal line.

11. The inspection method for a display device according to claim 6, wherein the control circuit board comprises a timing controller and a drive circuit board, the timing controller is connected to the drive circuit board, and the drive circuit board is connected to the gate drive circuits.

* * * * *